US007391295B2

(12) United States Patent
Wang et al.

(10) Patent No.: US 7,391,295 B2
(45) Date of Patent: Jun. 24, 2008

(54) HIGH VOLTAGE OVER-CURRENT PROTECTION DEVICE

(75) Inventors: Shau Chew Wang, Taipei (TW); Jyh Ming Yu, Kaohsiung (TW); Kuo Hsun Chen, Toufen Town (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 11/691,672

(22) Filed: Mar. 27, 2007

(65) Prior Publication Data

US 2008/0100979 A1 May 1, 2008

(30) Foreign Application Priority Data

Nov. 1, 2006 (TW) ..... 95140365 A

(51) Int. Cl.
*H01C 7/00* (2006.01)
*H01C 7/13* (2006.01)

(52) U.S. Cl. ..... 338/22 R; 338/20; 219/548; 252/511

(58) Field of Classification Search ..... 338/20, 338/22 R, 328, 332; 219/548–549, 541; 252/511–513, 518–519
See application file for complete search history.

(56) References Cited

U.S. PATENT DOCUMENTS

| | | | | |
|---|---|---|---|---|
| 4,955,267 | A * | 9/1990 | Jacobs et al. | 29/611 |
| 5,140,297 | A * | 8/1992 | Jacobs et al. | 338/22 R |
| 5,195,013 | A | 3/1993 | Jacobs et al. | |
| 5,227,946 | A * | 7/1993 | Jacobs et al. | 361/106 |
| 5,856,773 | A * | 1/1999 | Chandler et al. | 338/22 R |
| 6,111,234 | A * | 8/2000 | Batliwalla et al. | 219/549 |
| 6,593,844 | B1 * | 7/2003 | Iwao et al. | 338/22 R |

* cited by examiner

*Primary Examiner*—K. Richard Lee
(74) *Attorney, Agent, or Firm*—Seyfarth Shaw LLP

(57) ABSTRACT

A high voltage over-current protection device includes a positive temperature coefficient (PTC) electrically conductive heat-dissipation layer and two metal electrodes. The PTC electrically conductive heat-dissipation layer includes at least one polymer, an electrically conductive filler, and a heat conductive filler. Due to the high thermal conductivity of the heat conductive filler (with a coefficient of thermal conductivity higher than 1 W/mK), the high voltage over-current protection device has a high thermal conduction characteristic, and the withstand voltage thereof can be substantially uniformly distributed in the PTC electrically conductive heat-dissipation layer to enhance its high voltage withstanding characteristic.

10 Claims, 8 Drawing Sheets

HIGH VOLTAGE OVER-CURRENT PROTECTION DEVICE

BACKGROUND OF THE INVENTION

1. Field of the Invention

The present invention relates to a high voltage over-current protection device, and more particularly to a high voltage over-current protection device with a PTC behavior.

2. Description of the Prior Art

The resistance of conventional PTC devices is sensitive to changes in temperature. When a PTC device is operated normally, the resistance remains at an extremely low value, so that the circuit operates normally. When the temperature rises to a critical value due to the occurrence of an over-current or over-temperature situation, the resistance of the PTC device may jump instantly to a high resistance state (for example, over $10^4$ ohm) to impede the excessive current, thereby protecting cells or circuit elements. Because the PTC device can effectively protect electronic products, the PTC device has been integrated into various devices to prevent damage caused by over-current.

Conventional PTC over-current protection devices used in high-voltage (over 250 volts) applications usually have a hot line layer or a hot zone in the PTC material layer when being tripped. The hot line layer is caused by the heat generated as the PTC material layer withstands most of the voltage. Moreover, compared with other regions of the PTC material layer, the hot line layer has a higher resistance. When current flows through the PTC material layer, the hot line layer is heated rapidly. When the temperature of the hot line layer rises (the resistance value rises at the same time), even if the current flowing through the PTC material layer is decreased, the increased resistance of the hot line layer will cause a rapid heating rate of the hot line layer, and a degradation of the polymers occurs in the hot line layer, thus resulting in the loss of the high voltage withstanding characteristic of the over-current protection device and damage to the over-current protection device.

Under high-voltage tripped state, the temperature at the hot line layer is much higher than the temperature at other area. This extremely non-uniform temperature distribution causes local non-uniform voltage withstanding property which results in local voltage breakdown failure. The high voltage withstanding capability of the PTC device depends strongly on the temperature dissipation capability. Good thermal management is essential to the high voltage withstanding characteristics of the PTC device.

Further, as for the fabricating process of an over-current protection device for high-voltage applications, U.S. Pat. Nos. 5,227,946 and 5,195,013 disclose a PTC over-current protection device, wherein the included polymers are irradiated to enhance their physical and electrical properties. Thereby, the high voltage withstanding characteristics of PTC over-current protection devices can be improved. However, the polymers may be degraded by the irradiation, and larger molecules are broken down into small molecules, thus losing the original physical and electrical properties. Moreover, the irradiation on the PTC material layer often is not uniform, which may deteriorate the ability to withstand high voltage. In addition, if the Co-60 γ-ray irradiation process is used for crosslinking, the irradiation must take a large amount of time to reach the required high irradiation dosage since the irradiation energy of Co-60 γ-ray is low. Consequently, the production throughput is greatly reduced. If the E-beam irradiation process is used for crosslinking, the irradiation time can be drastically reduced. However, the internal stress inside the PTC matrix may be incurred as large amount of heat is generated during the irradiation. The internal stress could result in deterioration of the PTC voltage endurance. The rapid generation and slow dissipation of heat during the irradiation process make the fabricating process difficult to control. The variation of temperature during the fabricating process causes inconsistent product quality as well as deteriorated PTC performance. Consequently, the high yield loss from the fabricating process results in high cost of the PTC device.

SUMMARY OF THE INVENTION

An aspect of the present invention is to provide a high voltage over-current protection device, wherein a heat conductive filler is added to make the high voltage over-current protection device exhibiting a high heat-transfer and heat-dissipation properties which result in substantially uniform temperature distribution in the PTC layer. Since the resistance of PTC material depends strongly on the temperature and the resistance strongly affects the voltage endurance of PTC material, one could clearly see that the faster to transfer heat to the entire PTC layer, the more uniform temperature distribution in PTC layer, and the more uniform voltage withstanding capability, and the less local temperature and resistance discrepancies across the entire PTC matrix. Thereby, the high voltage-withstanding characteristic of the over-current protection device is improved, and meanwhile disadvantages such as degradation and internal stress easily caused by high dosage irradiation for crosslinking can be avoided.

The present invention provides a high voltage over-current protection device, which includes a PTC electrically conductive heat-dissipation layer and two metal electrodes. The PTC electrically conductive heat-dissipation layer includes at least one polymer, an electrically conductive filler, and a heat conductive filler, wherein the electrically conductive filler and the heat conductive filler are substantially uniformly distributed in the polymer. Moreover, in order to make the PTC electrically conductive heat-dissipation layer exhibit a high thermal conduction characteristic, the thermal conductivity coefficient of the heat conductive filler is higher than 1 W/mK. The PTC electrically conductive heat-dissipation layer exhibits a uniform voltage distribution when tripped. The weight ratio of the heat conductive filler to the electrically conductive filler ranges from 0.1 to 10.0, preferably from 0.2 to 5.0, more preferably from 0.33 to 3.0, and most preferably from 0.5 to 2.0. The heat conductive filler is selected from the materials with high thermal conductivity, such as nitride, oxide, and hydroxide, which mainly use 5%-50% by weight of heat conductive ceramic powders. The two metal electrodes are disposed on the upper and lower surfaces of the PTC electrically conductive heat-dissipation layer to form an electrically conductive path.

Compared with a conventional high voltage over-current protection device fabricated by a high irradiation dosage (over 50 Mrad), the present invention has the following advantages: (1) no irradiation is required, and thus unzipping and degradation of molecular bonds in the PTC electrically conductive heat-dissipation layer are eliminated; (2) no irradiation is required, and thus the time regarding the fabrication process of the present invention is far less than the time of a high irradiation dose (over 50 Mrad) process on the conventional high voltage withstanding material, thus significantly increasing the production efficiency; (3) the problem of non-uniform irradiation caused by the non-uniform shielding of other objects during high dose irradiation can be eliminated in the present invention; and (4) no longer needs to carefully control the irradiation temperature since the present invention is in no need for high dosage irradiation as taught by the prior art, in which the material temperature during irradiation should be controlled in a narrow range (lower than 85° C.) in order to eliminate the damage from the local hot spots generated by high dosage E-beam irradiation.

The electrically conductive heat-dissipation PTC of the present invention can be crosslinked and cured through chemical reactions, and can also be cured through a low radiation dose (e.g., below 20 Mrad).

BRIEF DESCRIPTION OF THE DRAWINGS

The invention will be described according to the appended drawings in which.

DETAILED DESCRIPTION OF THE INVENTION

The high voltage over-current protection device of the present invention and the fabricating method thereof are illustrated below with reference to the drawings.

The fabricating method involves first setting a feeding temperature of a batch blender (Hakke-600) at 160° C., and adding a premix material (the premix material is first put into a copper cup and stirred uniformly by a measuring spoon). The rotation speed of the blender is 40 rpm. After 3 minutes, the rotation speed of the blender is raised to 70 rpm, and the material is continuously blended for 12 minutes and then discharged, so as to form an electrically conductive composite material with PTC characteristics. The premixed material includes a first high-density polythene (HDPE-1, refer to Table 1 below), a second high-density polythene (HDPE-2, refer to Table 1 below), an electrically conductive filler, and a heat conductive filler. Table 1 shows the components of the premixed material in a comparative example and in each embodiment of the high voltage over-current protection device of the present invention. The heat conductive filler used in the embodiments 1-3 is boron nitride (BN), and the components of the premixed material in the comparative example do not include the heat conductive filler but do include a flame retardant ($Mg(OH)_2$). The numbers in Table 1 are all weight percentages.

TABLE 1

| Weight Percentage (%) | HDPE-1 | HDPE-2 | $Mg(OH)_2$ | BN | CB |
|---|---|---|---|---|---|
| Comparative Example | 33 | 7 | 30 | 0 | 30 |
| Embodiment 1 | 34 | 5 | 0 | 31 | 30 |
| Embodiment 2 | 35 | 5 | 0 | 32 | 28 |
| Embodiment 3 | 35 | 5 | 0 | 34 | 26 |

The melt index of HDPE-1 is 0.7 g/10 min, and the specific weight is 0.943. The melt index of HDPE-2 is 0.05 g/10 min, and the specific weight is 0.956. Raven 430U of Columbian Chemicals Company is used as CB. MgOH-650 of UBE Material Industries Ltd is used as $Mg(OH)_2$. Boron nitride Sp-2 of DENKA is used as BN.

Figure 1:
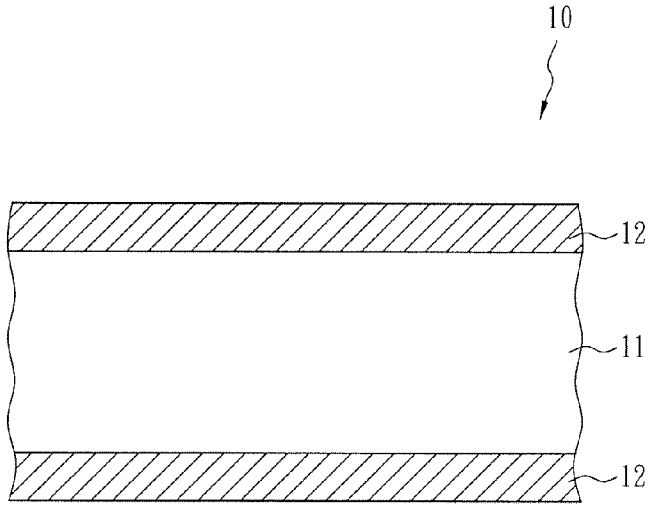
FIG. 1 is a schematic view of the high voltage over-current protection device of the present invention.

Next, the electrically conductive composite material is put in a mold with copper plates as the outer layer and a required thickness in the middle (2.1 mm or 3.4 mm), wherein a Teflon mold release fabric is disposed on and below the mold respectively. The mold is pre-heated for 8 minutes, and then pressed for 2 minutes (under an operating pressure of 100 kg/cm$^2$ and a temperature of 160° C.). After the pressing for the first time, a PTC electrically conductive heat-dissipation layer 11 with PTC characteristic is formed (refer to FIG. 1). Then, the PTC electrically conductive heat-dissipation layer 11 is cut into a square of 20×20 cm$^2$. A metal foil is disposed on the upper and lower surfaces of the PTC electrically conductive heat-dissipation layer 11 respectively, and after that, a second pressing is performed, in which the operating conditions include pre-heating for 5 minutes and then pressing for 2 minutes (under an operating pressure of 50 kg/cm$^2$, and a temperature of 160° C.), so as to form a metal electrode 12 on the upper and lower surfaces of the PTC electrically conductive heat-dissipation layer 11 respectively. Thereafter, a high voltage over-current protection device 10 with an area of 7.7 mm×7.7 mm is formed by die punching and cutting, and then is used in the subsequent electrical characteristic test. The resistance of the high voltage over-current protection device 10 is measured by a micro-ohmmeter four-wire method.

Table 2 shows the comparison of the dimensions, volume resistance value (ρ), and the results of high voltage test of the comparative example 1 and the embodiments 1-3 of the high voltage over-current protection device of the present invention in Table 1.

TABLE 2

| | Dimension (mm × mm) | Thickness (mm) | Volume Resistance Value ρ (Ω-cm) | cycles | High voltage test |
|---|---|---|---|---|---|
| Comparative Example | 7.7 × 7.7 | 3.38 | 8.36 | 0 | burnt |
| Embodiment 1 | 7.7 × 7.7 | 3.62 | 5.49 | 5 | Normal |
| Embodiment 2 | 7.7 × 7.7 | 3.36 | 6.23 | 5 | Normal |
| Embodiment 3 | 7.7 × 7.7 | 3.37 | 9.46 | 8 | Normal |

The column "Cycles" in Table 2 refers to connecting the two metal electrodes of the high voltage over-current protection device to a high voltage (600 volts) high current (3 amperes) power supply, and powering on for 1 second, and then powering off for 60 seconds, which represents one cycle.

The column "High voltage test" refers to connecting the two metal electrodes of the high voltage over-current protection device to the high voltage (600 volts) high current (3 amperes) power supply, powering on for 30 minutes, and then recording the results. Note that Embodiments 1-3 can withstand a current smaller than or equal to 3 amperes.

Figure 2:
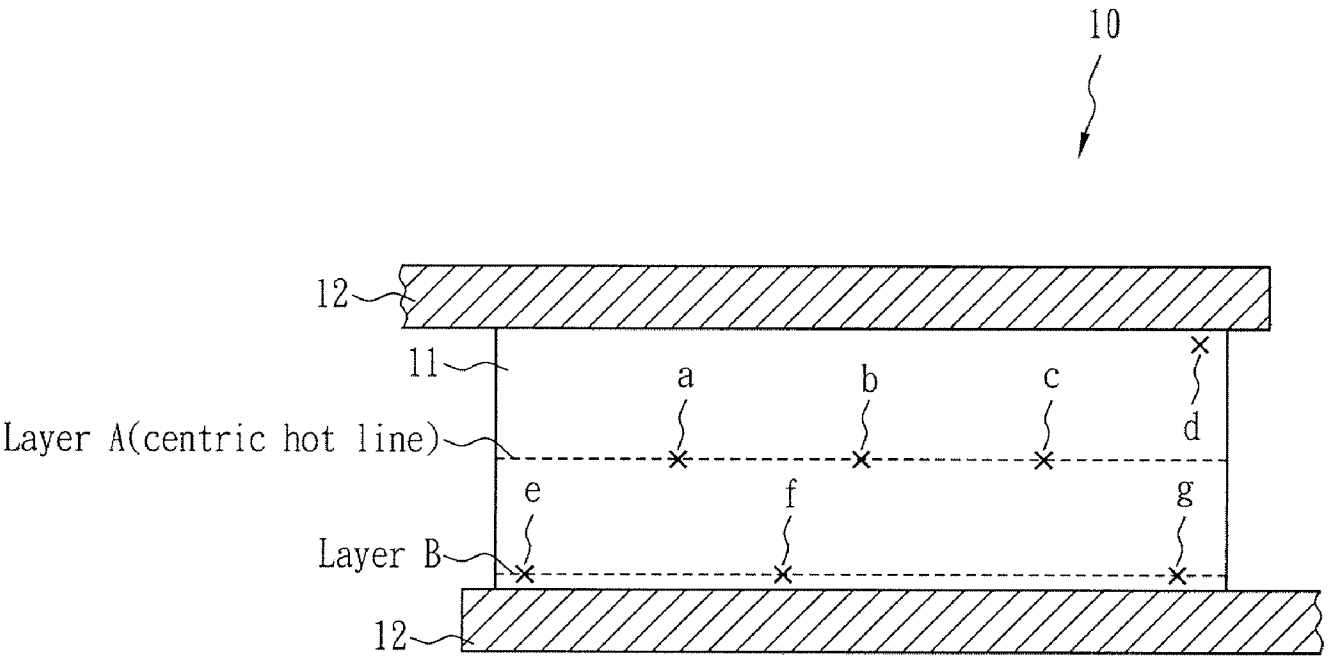
FIG. 2 is a schematic view of the positions of the temperature measuring points.

Table 3 shows the temperature data (in a unit of ° C.) measured by an infrared thermal imager at different time points and different surface positions when the comparative example and Embodiment 3 undergo the high voltage test in Table 2. Referring to FIG. 2, a schematic view of the positions of the temperature measuring points a, b, c, d, e, f, and g on the high voltage over-current protection device 10 is shown. The measuring points a, b, and c are positioned in the center between the two metal electrodes 12 on the surface of the PTC electrically conductive heat-dissipation layer 11. The measuring points e, f, and g are positioned on the surface of the PTC electrically conductive heat-dissipation layer 11 close to the lower metal electrode 12. The measuring point d is positioned on the surface of the PTC electrically conductive heat-dissipation layer 11 close to the upper metal electrode 12. FIGS. 3(*a*), 4(*a*), 5(*a*), 6(*a*), 7(*a*), and 8(*a*) are infrared thermal images taken at the 3rd, 5th, 7th, 15th, 30th, and 50th seconds, respectively, after a high voltage (600 volts) high current (3 amperes) power supply is applied to the comparative example. FIGS. 3(*b*), 4(*b*), 5(*b*), 6(*b*), 7(*b*), and 8(*b*) are infrared thermal images taken at the 3rd, 5th, 7th, 15th, 30th, and 50th seconds, respectively, after the high voltage (600 volts) high current (3 amperes) power supply is applied in Embodiment 3. Note that the numbers in white shown in FIGS. 3(*a*)-8(*b*) indicate the temperature readings.

TABLE 3

Figure 3A:
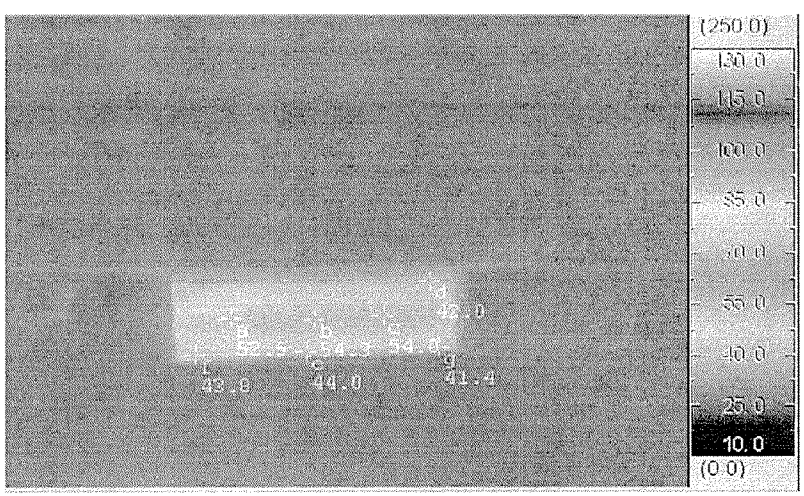
FIGS. 3(*a*) and 3(*b*) are infrared thermal images taken at the 3rd second in the high voltage test of the comparative example and the third embodiment.
Figure 3B:
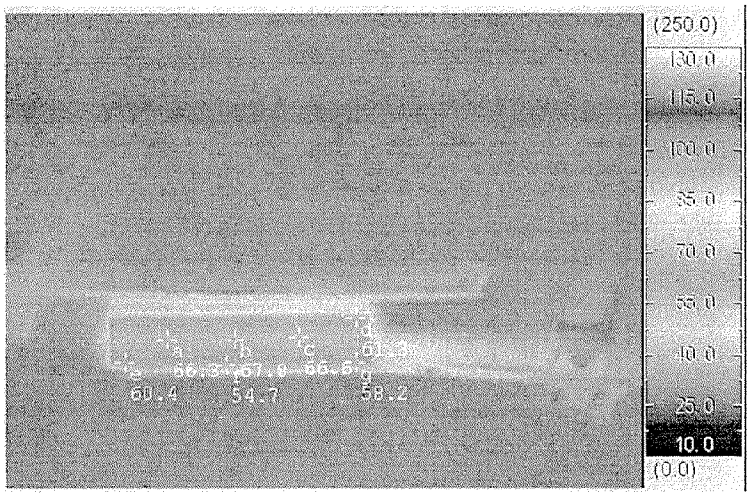
Figure 4A:
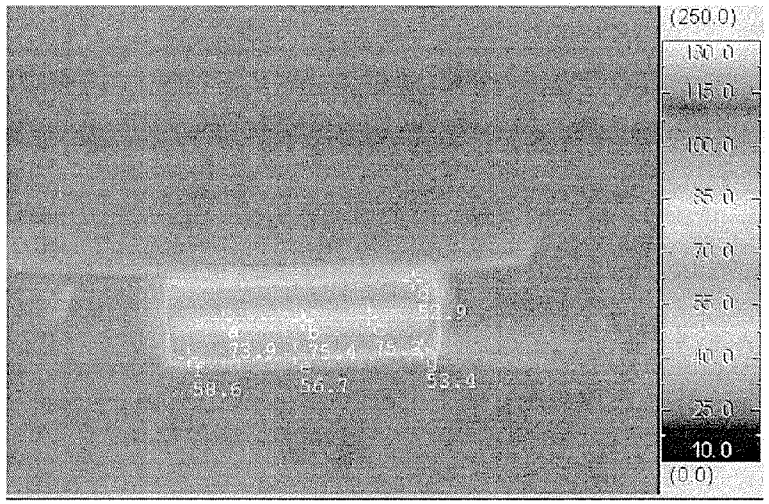
FIGS. 4(*a*) and 4(*b*) are infrared thermal images taken at the 5th second in the high voltage test of the comparative example and the third embodiment.
Figure 5A:
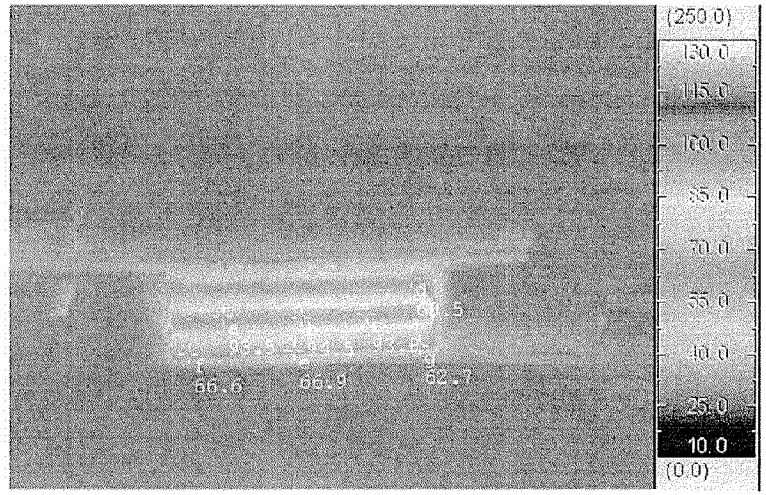
FIGS. 5(*a*) and 5(*b*) are infrared thermal images taken at the 7th second in the high voltage test of the comparative example and the third embodiment.
Figure 6A:
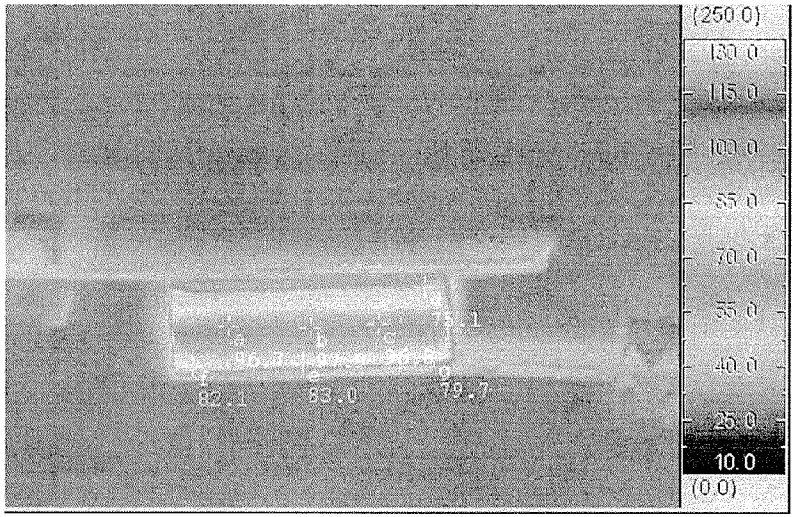
FIGS. 6(*a*) and 6(*b*) are infrared thermal images taken at the 15th second in the high voltage test of the comparative example and the third embodiment.
Figure 6B:
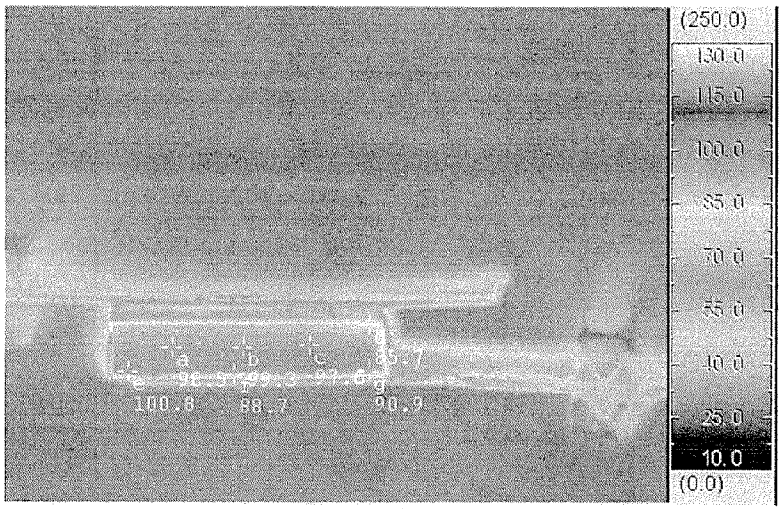
Figure 7A:
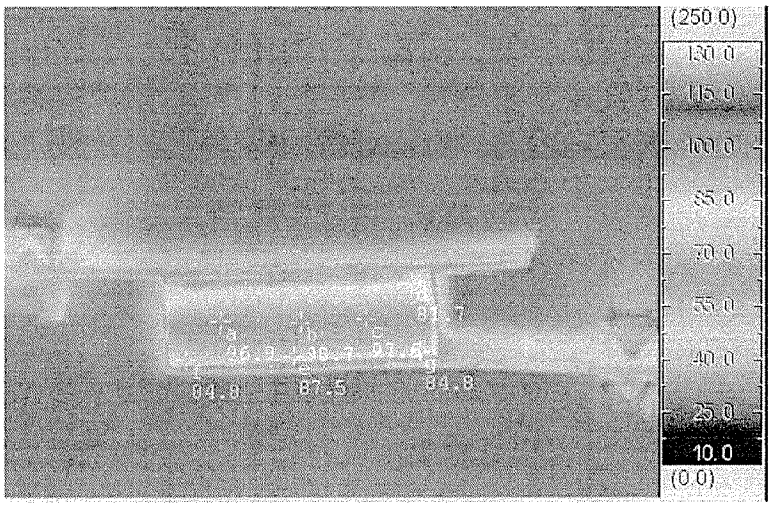
FIGS. 7(*a*) and 7(*b*) are infrared thermal images taken at the 30th second in the high voltage test of the comparative example and the third embodiment.
Figure 7B:
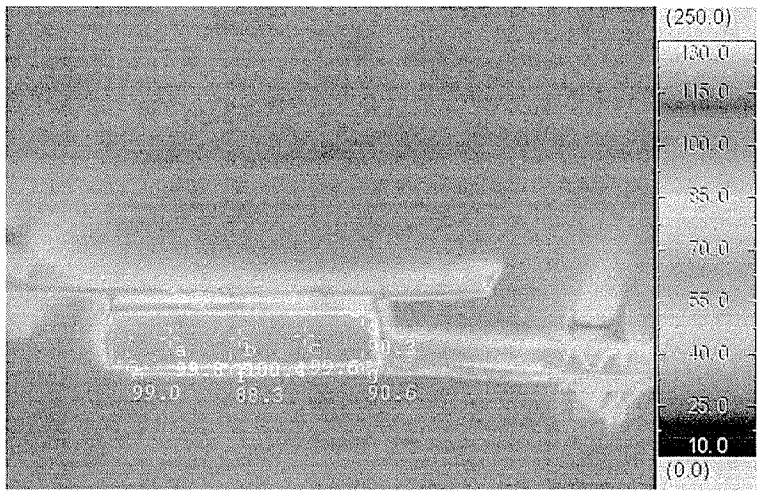
Figure 8B:
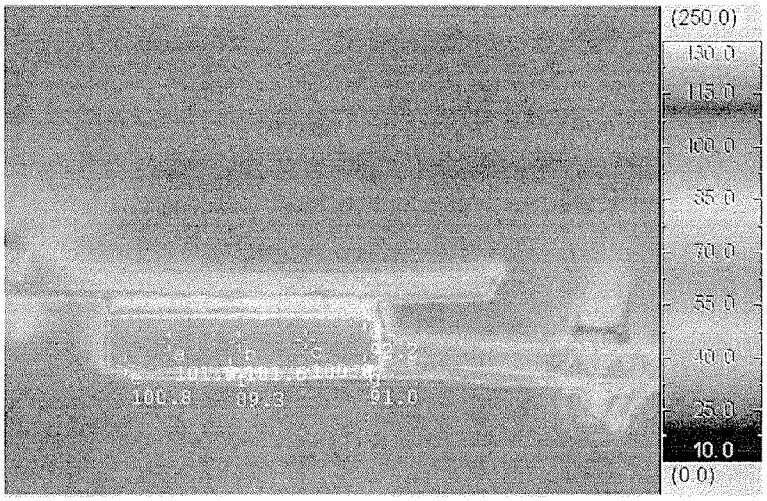
FIGS. 8(*a*) and 8(*b*) are infrared thermal images taken at the 50th second in the high voltage test of the comparative example and the third embodiment.
Figure 8A:
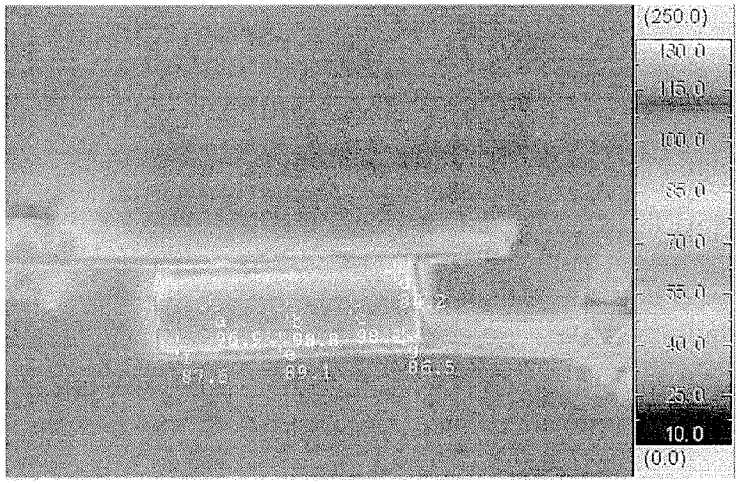

| | Time(s) | | | | | |
|---|---|---|---|---|---|---|
| | 3 | 5 | 7 | 15 | 30 | 50 |
| | Corresponding Figure | | | | | |
| | FIG. 3(a) | FIG. 4(a) | FIG. 5(a) | FIG. 6(a) | FIG. 7(a) | FIG. 8(a) |
| | Comparative Example | | | | | |
| Measuring Point a | 52.5 | 73.9 | 93.5 | 97.6 | 96.9 | 96.9 |
| Measuring Point b | 54.3 | 75.4 | 94.5 | 97.9 | 98.7 | 98.8 |
| Measuring Point c | 54.0 | 75.3 | 93.8 | 96.8 | 97.6 | 98.1 |
| Measuring Point d | 42.0 | 52.9 | 60.5 | 75.1 | 81.7 | 84.2 |
| Measuring Point e | 43.8 | 58.6 | 66.6 | 82.1 | 84.8 | 87.6 |
| Measuring Point f | 44.0 | 56.7 | 66.9 | 83.0 | 87.5 | 89.1 |
| Measuring Point g | 41.4 | 53.4 | 62.7 | 79.7 | 84.8 | 86.5 |
| Average Temperature Value ($T_A(t)$) of Measuring Points a, b, c in Layer A | 53.6 | 74.9 | 93.9 | 97.4 | 97.7 | 97.9 |
| Temperature Rise Value $\Delta T_A(t)$ in Layer A: ($T_A(t)$-25) | 28.6 | 49.9 | 68.9 | 72.4 | 72.7 | 72.9 |
| Temperature Rise Ratio in Layer A $\Delta T_A(t)/\Delta T_A(50)$ | 39.23% | 68.45% | 94.51% | 99.31% | 99.73% | 100.00% |
| Average Temperature Value ($T_B(t)$) of Measuring Points e, f, g in Layer B | 43.1 | 56.2 | 65.4 | 81.6 | 85.7 | 87.7 |
| Temperature Rise Value $\Delta T_B(t)$ in Layer B: ($T_B(t)$-25) | 18.1 | 31.2 | 40.4 | 56.6 | 60.7 | 62.7 |
| Temperature Rise Ratio in Layer B $\Delta T_B(t)/\Delta T_A(50)$ | 24.83% | 42.80% | 55.42% | 77.64% | 83.26% | 86.01% |
| $T_A(t) - T_B(t)$ | 10.5 | 18.6 | 28.5 | 15.8 | 12.0 | 10.2 |
| | Embodiment 3 | | | | | |
| Measuring Point a | 66.3 | 98.1 | 99.2 | 98.5 | 99.8 | 101.0 |
| Measuring Point b | 67.8 | 100.2 | 100.1 | 99.3 | 100.4 | 101.6 |
| Measuring Point c | 66.6 | 97.8 | 97.6 | 97.6 | 99.6 | 100.8 |
| Measuring Point d | 61.3 | 80.2 | 81.6 | 85.7 | 90.3 | 92.2 |
| Measuring Point e | 60.4 | 84.9 | 93.0 | 100.8 | 99.0 | 100.8 |
| Measuring Point f | 54.7 | 76.1 | 83.1 | 88.7 | 88.3 | 89.3 |
| Measuring Point g | 58.2 | 81.6 | 86.4 | 90.9 | 90.6 | 91.0 |
| Average Temperature Value ($T_A(t)$) of Measuring Points a, b, c in Layer A | 66.9 | 98.7 | 99.0 | 98.5 | 99.9 | 101.1 |
| Temperature Rise Value $\Delta T_A(t)$ in Layer A: ($T_A(t)$-25) | 41.9 | 73.7 | 74.0 | 73.5 | 74.9 | 76.1 |

TABLE 3-continued

| | Time(s) | | | | | |
|---|---|---|---|---|---|---|
| | 3 | 5 | 7 | 15 | 30 | 50 |
| | Corresponding Figure | | | | | |
| | FIG. 3(a) | FIG. 4(a) | FIG. 5(a) | FIG. 6(a) | FIG. 7(a) | FIG. 8(a) |
| Temperature Rise Ratio in Layer A $\Delta T_A(t)/\Delta T_A(50)$ | 55.06% | 96.85% | 97.24% | 96.58% | 98.42% | 100.00% |
| Average Temperature Value ($T_B(t)$) of Measuring Points e, f, g in Layer B | 57.8 | 80.9 | 87.5 | 93.5 | 92.6 | 93.7 |
| Temperature Rise Value $\Delta T_B(t)$ in Layer B: ($T_B(t)$-25) | 32.8 | 55.9 | 62.5 | 68.5 | 67.6 | 68.7 |
| Temperature Rise Ratio in Layer B $\Delta T_B(t)/\Delta T_A(50)$ | 43.10% | 73.46% | 82.13% | 90.01% | 88.83% | 90.28% |
| $T_A(t)-T_B(t)$ | 9.1 | 17.8 | 11.5 | 5.0 | 7.3 | 7.4 |

$\Delta T_A(t)$ stands for the temperature rise value of a centric hot line layer (or referred to as Layer A in FIG. 2), which is equal to the average temperature value (A) of measuring point a, b and c at a time t minus the room temperature 25° C. $\Delta T_B(t)$ stands for the temperature rise value of the surface of the PTC electrically conductive heat-dissipation layer 11 (or referred to as Layer B in FIG. 2), which is equal to the average temperature value ($T_B(t)$) of measuring point e, f and g at a time t minus the room temperature 25° C. That is, $\Delta T_B(t)$ stands for a temperature difference between a tripped-state surface layer temperature of the PTC electrically conductive heat-dissipation layer being tripped for t seconds and the room temperature. Thus, $\Delta T_B(t)$ can be expressed as the following equation:

$$\Delta T_B(t)=T_B(t)-25.$$

For example, $\Delta T_A(50)$ stands for the temperature difference (temperature rise value) between the tripped-state centric hot line layer temperature when tripped for 50 seconds and the room temperature, which is equal to the average temperature value ($T_A(t)$, t=50) of each measuring point a, b, c at the 50th second minus the room temperature 25° C. $\Delta T_A(50)$ can be calculated by the equation: $\Delta T_A(50)=T_A(50)-25$. $\Delta T_B(t)/\Delta T_A(50)$ stands for the temperature rise ratio of Layer B, also referred to as "surface layer temperature rise ratio," which is equal to a ratio of the surface layer temperature rise value at a time t to the centric layer temperature rise value at the 50th second based on the room temperature. In the comparative example, the temperature rise ratio of the surface layer (e.g., Layer B in FIG. 2) does not reach 45% at 5th second, 60% at 7th second, and 80% at 15th second. However, in Embodiment 3, the temperature rise ratio of the surface layer exceeds 60% in 5 seconds and 80% in 7 seconds, which shows that the heat conductive rate of the material in Embodiment 3 is much higher than that in the comparative example. Generally speaking, when the PTC electrically conductive heat-dissipation layer of the present invention is tripped, the surface layer temperature rise ratio exceeds 60% in 5 seconds.

Figure 4B:
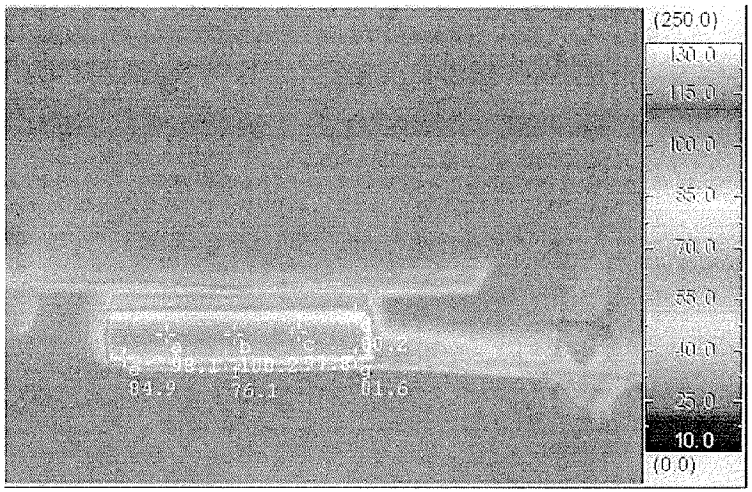
Figure 5B:
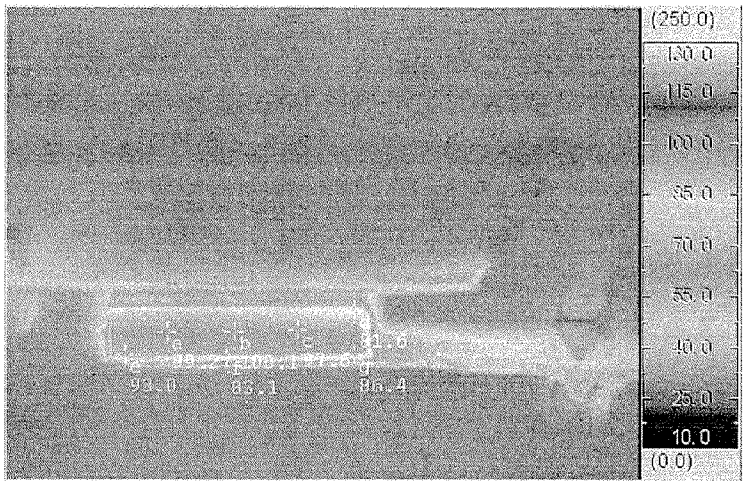

FIGS. 4(*a*) and 4(*b*) are infrared thermal images of the comparative example and Embodiment 3 of the present invention when tripped under the high voltage test in Table 2, respectively. FIG. 4(*b*) has a temperature distribution which is more uniform than FIG. 4(*a*) (the values of the two rows "($T_A(t)$)-($T_B(t)$)" in Table 3 show that Embodiment 3 of the present invention has a smaller temperature difference, which means that the PTC electrically conductive heat-dissipation layer 11 has a smaller temperature difference between the center and the edge). The reason is that the comparative example employs only the hot line region (the region with a temperature above 70° C. and covering a quarter to one-third of the lateral area of the PTC electrically conductive heat-dissipation layer) to withstand the voltage; however, when Embodiment 3 of the present invention is tripped, the PTC electrically conductive heat-dissipation layer 11 has a uniform voltage distribution (i.e., the whole PTC electrically conductive heat-dissipation layer 11 withstands the voltage uniformly). Also, the PTC electrically conductive heat-dissipation layer 11 of the present invention includes the heat conductive filler substantially distributed uniformly therein, and thus the heat can be uniformly dissipated at a high rate (refer to FIGS. 5(*a*) and 5(*b*), 6(*a*) and 6(*b*), 7(*a*) and 7(*b*), 8(*a*) and 8(*b*)). Embodiment 3 has a temperature distribution region when tripped, wherein the temperature distribution region exhibits a temperature above 80° C. and has an area over 50% of the lateral area of the PTC electrically conductive heat-dissipation layer 11.

According to the experimental data in Table 1, Table 2, and Table 3, as the embodiments 1-3 of the high voltage over-current protection device of the present invention has the heat conductive filler of high thermal conductivity substantially uniformly distributed in the PTC electrically conductive heat-dissipation layer, hence the protection device can pass the high voltage test and cycles under a high voltage (600 volts) and high current (3 amperes) without the assistance of cross-linking achieved by radiation or chemical reaction. However, the comparative example cannot pass the high voltage test and is burned. As the heat conductive filler is substantially uniformly distributed in the PTC electrically conductive heat-dissipation layer, when the high voltage over-current protection device is connected to the high voltage high current power supply, the generated heat can be dispersed rapidly, so as to eliminate a high current density region in the PTC electrically conductive heat-dissipation layer, thus preventing the forming of the hot line and the degradation of the polymers in the PTC electrically conductive heat-dissipation layer. That is, the withstanding voltage of the high voltage over-current protection device is substantially uniformly distributed in the PTC electrically conductive heat-dissipation layer between the two metal electrodes instead of being concentrated in the hot line region.

In view of the above, as the high voltage over-current protection device of the present invention has a high thermal conductivity characteristic, when tripped, the temperature difference between the centric hot line layer and the surface layer can be reduced rapidly, so as to greatly improve the uniformity of the temperature distribution and the uniformity of the withstanding voltage distribution of the PTC electrically conductive heat-dissipation layer. Accordingly, the damage to the device caused by the voltage concentrated in the narrow hot line region due to the poor thermal conductivity can be effectively avoided. Meanwhile, the fabricating method of the high voltage over-current protection device of the present invention does not need irradiation, so the degradation of the device and the internal stress caused by irradiation are avoided, and the high voltage withstanding characteristic of the device can be enhanced.

The devices and features of this invention have been sufficiently described in the above examples and descriptions. It should be understood that any modifications or changes without departing from the spirit of the invention are intended to be covered in the protection scope of the invention.

What is claimed is:

1. A high voltage over-current protection device, comprising:

a positive temperature coefficient (PTC) electrically conductive heat-dissipation layer, comprising:

at least one polymer;

an electrically conductive filler substantially uniformly distributed in the polymer; and a heat conductive filler uniformly substantially distributed in the polymer; and two metal electrodes disposed on upper and lower surfaces of the PTC electrically conductive heat-dissipation layer, respectively, so as to form an electrically conductive path;

wherein the withstand voltage of the high voltage over-current protection device is larger than 250 volts and the PTC electrically conductive heat-dissipation layer has the following characteristic when tripped:

$$\Delta T_B(5)/\Delta T_A(50)>60\%$$

wherein $\Delta T_B(5)$ stands for a temperature difference between a tripped-state surface layer temperature of the PTC electrically conductive heat-dissipation layer being tripped for 5 seconds and the room temperature, and $\Delta T_A(50)$ stands for a temperature difference between a tripped-state centric hot line layer temperature of the PTC electrically conductive heat-dissipation layer being tripped for 50 seconds and the room temperature.

2. The high voltage over-current protection device of claim 1, which can withstand a current smaller than or equal to 3 amperes.

3. The high voltage over-current protection device of claim 1, wherein the electrically conductive filler is carbon black.

4. The high voltage over-current protection device of claim 1, wherein the heat conductive filler is a nitride, oxide, or hydroxide.

5. The high voltage over-current protection device of claim 4, wherein the nitride is boron nitride.

6. The high voltage over-current protection device of claim 1, wherein the thermal conductivity coefficient of the heat conductive filler is larger than 1 W/mK.

7. The high voltage over-current protection device of claim 1, wherein the polymer comprises high-density polythene.

8. The high voltage over-current protection device of claim 1, further comprising a temperature distribution region with a temperature above 80° C. when tripped, wherein the temperature distribution region has an area over 50% of the lateral area of the PTC electrically conductive heat-dissipation layer.

9. The high voltage over-current protection device of claim 1, wherein the weight percentage of the heat conductive filler in the PTC electrically conductive heat-dissipation layer ranges from 30% to 35%.

10. The high voltage over-current protection device of claim 1, wherein the weight ratio between the heat conductive filler and the electrically conductive filler ranges from 0.5 to 2.0.

* * * * *